US011370082B2

(12) United States Patent
Karandikar et al.

(10) Patent No.: US 11,370,082 B2
(45) Date of Patent: Jun. 28, 2022

(54) DIAMOND COMPOSITE CMP PAD CONDITIONER

(71) Applicant: M Cubed Technologies, Inc., Newtown, CT (US)

(72) Inventors: Prashant G. Karandikar, Avondale, PA (US); Michael K. Aghajanian, Newark, DE (US); Edward Gratrix, Monroe, CT (US); Brian J. Monti, Avon, CT (US)

(73) Assignee: M Cubed Technologies, Inc., Newton, CT (US)

( * ) Notice: Subject to any disclaimer, the term of this patent is extended or adjusted under 35 U.S.C. 154(b) by 789 days.

(21) Appl. No.: 15/481,443

(22) Filed: Apr. 6, 2017

(65) Prior Publication Data

US 2017/0291279 A1 Oct. 12, 2017

Related U.S. Application Data

(60) Provisional application No. 62/319,283, filed on Apr. 6, 2016.

(51) Int. Cl.
*B24B 53/017* (2012.01)
*B24B 53/12* (2006.01)

(52) U.S. Cl.
CPC ..... *B24B 53/017* (2013.01); *B24B 53/12* (2013.01)

(58) Field of Classification Search
CPC ..... B24B 53/017
See application file for complete search history.

(56) References Cited

U.S. PATENT DOCUMENTS 6,540,597 B1 4/2003 Ohmori
7,467,989 B2 12/2008 Lin et al.
(Continued)

FOREIGN PATENT DOCUMENTS

CN 102173806 A 9/2011
JP 2016087735 A 5/2016
KR 20100037284 A 4/2010

OTHER PUBLICATIONS

International Search Report dated Jun. 29, 2017 for International Application No. PCT/US17/26465.
(Continued)

*Primary Examiner* — Joseph J Hail
*Assistant Examiner* — J Stephen Taylor
(74) *Attorney, Agent, or Firm* — Blank Rome LLP

(57) ABSTRACT

A chemical-mechanical polishing/planarization pad conditioner body made from diamond-reinforced reaction bonded silicon carbide, with diamond particles protruding or "standing proud" of the rest of the surface, and uniformly distributed on the cutting surface. In one embodiment, the diamond particles are approximately uniformly distributed throughout the composite, but in other embodiments they are preferentially located at and near the conditioning surface. The tops of the diamond particles can be engineered to be at a constant elevation (i.e., the conditioner body can be engineered to be very flat). Exemplary shapes of the body may be disc or toroidal. The diamond particles can be made to protrude from the conditioning surface by preferentially eroding the Si/SiC matrix. The eroding may be accomplished by electrical discharge machining or by lapping/polishing with abrasive.

43 Claims, 5 Drawing Sheets

(56) References Cited

U.S. PATENT DOCUMENTS

| | | | | |
|---|---|---|---|---|
| 8,445,887 | B2 | 5/2013 | Yoon et al. | |
| 8,474,362 | B1 * | 7/2013 | Karandikar | C04B 35/565 89/36.02 |
| 2002/0127962 | A1 | 9/2002 | Cho et al. | |
| 2002/0182401 | A1 * | 12/2002 | Lawing | B24B 37/005 428/323 |
| 2003/0084894 | A1 * | 5/2003 | Sung | B23P 15/28 125/12 |
| 2006/0079162 | A1 * | 4/2006 | Yamashita | B24B 53/017 451/444 |
| 2007/0049185 | A1 * | 3/2007 | Lin | B24B 53/017 451/443 |
| 2007/0066194 | A1 * | 3/2007 | Wielonski | B24B 53/017 451/443 |
| 2010/0081360 | A1 | 4/2010 | Xu et al. | |
| 2010/0273402 | A1 | 10/2010 | Shimizu | |
| 2012/0083189 | A1 | 4/2012 | Choi et al. | |
| 2013/0078895 | A1 | 3/2013 | Dinh-Ngoc et al. | |
| 2015/0087212 | A1 | 3/2015 | Doering et al. | |
| 2018/0001441 | A1 * | 1/2018 | Ang | B24D 13/20 |

OTHER PUBLICATIONS

A. Scott Lawing, Elbert Chou, Asa Yamada, "Advances in CMP Pad Conditioning", *NCCAVS CMPUG Synposium on CMP Technology and Market Trends*, Semicon West, San Francisco, CA, Jul. 15, 2016.

"Diamond Pad Conditioners for CMP", 3M Company, Electronic Markets Materials Division, St. Paul, MN, 2008.

Timothy Dyer and Jim Schlueter, "Characterizing CMPpad conditioning using diamond abrasives", micromagazine.com, Jan. 2002.

"Chemical-mechanical planarization", Wikipedia, the free encyclopedia, en.wikipedia.com/chemical-mechanical_planarization, Feb. 25, 2017.

* cited by examiner

DIAMOND COMPOSITE CMP PAD CONDITIONER

CROSS-REFERENCE TO RELATED APPLICATION(S)

This patent document claims the benefit of commonly owned U.S. Provisional Patent Application No. 62/319,283, filed on Apr. 6, 2016. Where permitted by law, the entire contents of this parent patent application are incorporated by reference herein.

TECHNICAL FIELD

The present invention relates to diamond-containing discs machined to very high flatness that are used to recondition chemical-mechanical polishing (CMP) pads that in turn are used to polish semiconductor wafers.

BACKGROUND ART

Modern electronics rely on microscopic chips fabricated in single crystal silicon (Si) substrates. First, a boule of single crystal Si is grown. This boule is then diced into thin Si wafers (300 mm diameter now, 450 mm diameter in the near future) with diamond wire saws. At this stage this Si wafers are thick and rough. The next processing step involves polishing these wafers to very high degree of flatness (rim level global flatness) and finish; as well as small thickness (<1 mm). The Si wafers thus produced are used for building the microscopic chips by depositing micro and nano-sized circuitry using processes such as lithography, metal deposition, etching, diffusion, ion implantation, etc. An exemplary application of chemical mechanical polishing (CMP) is in polishing unprocessed Si wafers to extremely high finish and flatness.

Refer now to FIGS. 1A and 1B, which are top and side views, respectively, of an apparatus for wafer planarization, including a machine for conditioning the CMP pad. In the CMP process, mechanical rubbing and chemical reaction are both used for material removal. This is done on polishing pads 101 (e.g. made of porous closed cell polyurethane) with slurries 103 of different abrasive/reactive compounds (such as alumina, ceria, etc.). More than one silicon wafer 105 can be polished at a time; thus, the polishing pads may be more than a meter in diameter. The polishing pad is mounted on a rigid substrate 107 that rotates on an axis 109 that is normal to the substrate. The abrasive media may be provided to the spinning polishing pad in the form of a slurry. The silicon wafer 105 is mounted to a holder or "chuck" 111, which also rotates on an axis 113 that is parallel to axis 109.

As polishing continues, the cells or pores in the polishing pads fill up with abrasive and debris from the wafers; they develop a glaze and lose effectiveness. However, the polishing pads still have useful life—they merely need to be re-conditioned from time-to-time to open up closed cells in the polyurethane pad, improve the transport of slurry to the wafer, and provide a consistent polishing surface throughout the pad's lifetime to achieve good wafer polishing performance. To recondition the CMP pads, disks called CMP pad conditioners are used that have protruding diamond on the surface with a recessed metal or organic matrix to retain the protruding diamonds. In these disks, typically, a single layer of coarse diamond (e.g. 125 micrometer diameter) is used, and the diamond spacing (e.g. 0.5 to 1 mm) and protrusion are carefully controlled. These diamond containing conditioning disks are machined to very high flatness. The key factors that provide good performance include sufficient protrusion of the diamond (good cutting ability), strong bond to matrix (prevents loss of diamond, loss of cutting ability, and prevents formation of debris that compromises conditioning).

The pad reconditioning discs 115 typically feature structure 117 that enables them to be mounted or attached to the arm 119 of a machine or fixture such that the axis 121 of the disc 115 is parallel to the rotational axis 109 of the CMP pad. The machine then brings the disc into contact with the rotating CMP pad and moves it back and forth from the periphery of the CMP pad to the center or near the center, but not necessarily radially. The machine may also impart rotation to the reconditioning disc. Introducing a liquid to the CMP pad during conditioning should help in removing debris that is dislodged by the disc.

To save time and thereby increase efficiency, the CMP pad reconditioning often is performed simultaneously with wafer polishing/planarization. One risk of this concurrent processing, however, is the risk of a diamond particle spalling or popping out of its matrix. The loose diamond material can gouge and ruin the silicon wafers being polished.

At least those CMP pad conditioning discs featuring diamond particulate bonded to metal have experienced problems in the past—specifically, loss of diamond particles (e.g., detachment). Without wishing to be bound to any particular theory or explanation, it could be that loss of diamond particulate results from chemical corrosion of the metal, or possibly due to mechanical stress resulting from thermal expansion mismatch and temperature excursions during processing. Thus, it is desirable to provide a pad conditioning disc that is less susceptible to diamond particulate loss than existing designs.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Described embodiments include a reaction bonded silicon carbide (RBSC) featuring a diamond particle reinforcement, and a process of manufacturing same. The RBSC comprises a matrix phase of reaction bonded silicon carbide (Si/SiC) in which diamond particles are embedded. This composite has very high mechanical and thermal stability, can be produced in having one or more dimensions of 450 mm and greater, and is machinable by electrical discharge machining (EDM), sometimes referred to as "spark discharge machining".

One application of this technology is a CMP pad conditioner disk made from the diamond-reinforced reaction bonded Si/SiC, with diamond particles protruding or "standing proud" of the rest of the surface, and uniformly distributed on the cutting surface. In one embodiment, the diamond particles are approximately uniformly distributed throughout the composite, but in other embodiments they are preferentially located at and near the conditioning surface. The tops of the diamond particles can be engineered to be at a constant elevation (i.e., the conditioner disc is very flat). Alternatively, the disc can be given a toroidal shape. The diamond particles can be made to protrude from the conditioning surface by preferentially eroding the Si/SiC matrix. The eroding may be accomplished by EDM or by lapping/polishing with abrasive.

BRIEF DESCRIPTION OF THE DRAWINGS

A more detailed understanding of the invention may be had from the following description, given by way of example, and to be understood in conjunction with the accompanying claims and drawings in which like reference numerals identify similar or identical elements. The drawings are not to scale.

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation".

It should be understood that the steps of the exemplary methods set forth herein are not necessarily required to be performed in the order described, and the order of the steps of such methods should be understood to be merely exemplary. Likewise, additional steps might be included in such methods, and certain steps might be omitted or combined, in methods consistent with various embodiments of the present invention.

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Figure 1A:
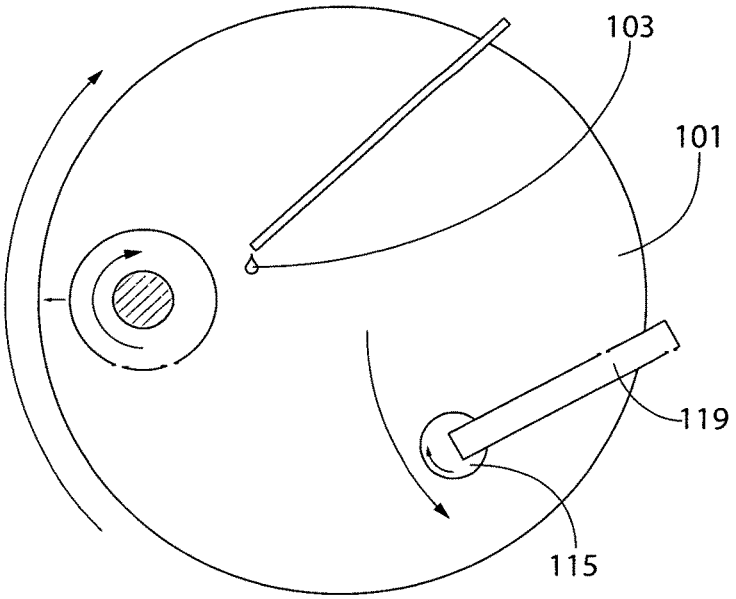
FIGS. 1A and 1B are top and side views, respectively, of a silicon wafer planarizing operation with simultaneous conditioning of the CMP pad.
Figure 1B:
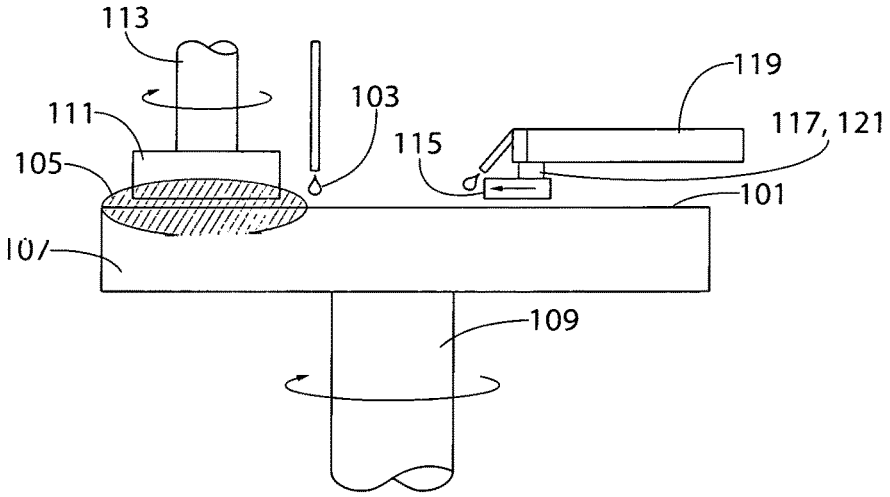
Figure 2:
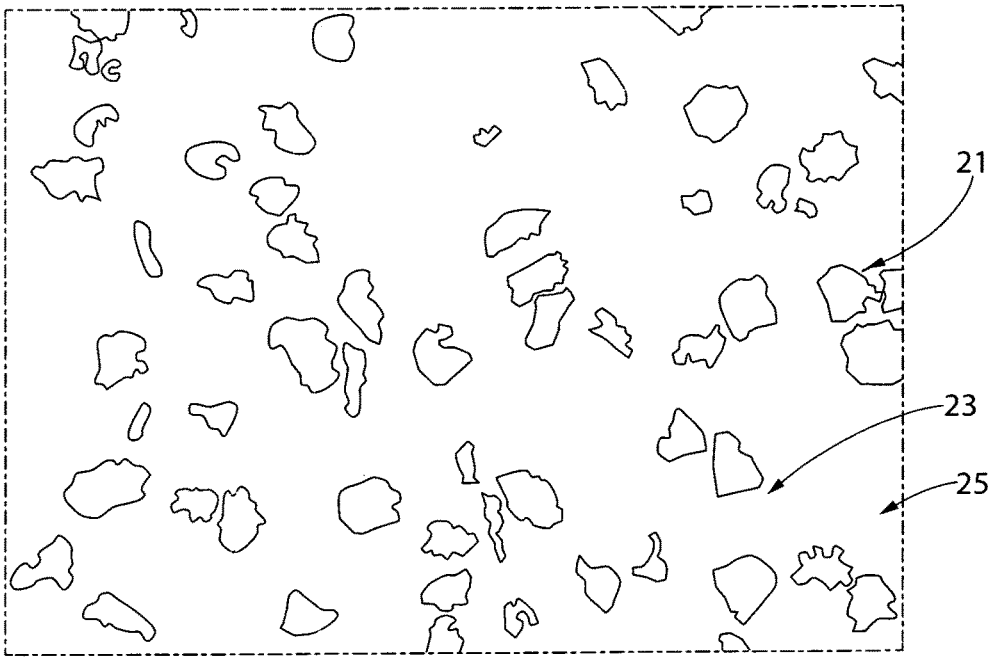
FIG. 2 is an exemplary RBSC-diamond microstructure.

In one embodiment, silicon carbide-based bodies can be made to near net shape by reactive infiltration techniques. In general, a reactive infiltration process entails contacting molten elemental silicon (Si) with a porous mass containing silicon carbide plus carbon in a vacuum or an inert atmosphere environment. A wetting condition is created, with the result that the molten silicon is pulled by capillary action into the mass, where it reacts with the carbon to form additional silicon carbide. This in-situ silicon carbide typically is interconnected. A dense body usually is desired, so the process typically occurs in the presence of excess silicon. The resulting composite body thus contains primarily silicon carbide, but also some unreacted silicon (which also is interconnected), and may be referred to in shorthand notation as Si/SiC. The process used to produce such composite bodies is interchangeably referred to as "reaction forming", "reaction bonding", "reactive infiltration" or "self-bonding". For added flexibility, one or more materials other than SiC can be substituted for some or all of the SiC in the porous mass. For example, replacing some of this SiC with diamond particulate can result in a diamond/SiC composite. An exemplary method to make reaction bonded SiC with diamond is disclosed in U.S. Pat. No. 8,474,362, which is incorporated herein by reference in its entirety. Material composition can be tailored with different amounts of diamond contents. Typically, these compositions have uniformly distributed diamond throughout the volume of the component. FIG. 2 shows an example of an RBSC-diamond composite microstructure. This scanning electron microscope (SEM) image is of a fracture surface, and shows the constituent diamond 21, silicon carbide 23 and elemental silicon 25. Diamond is a material with very high hardness, thermal conductivity, wear resistance, high stiffness, and low friction coefficient. These high properties are imparted to the diamond-containing Si/SiC. It has also been shown that the RBSC diamond material can be polished such that the diamonds stand proud (protrude) and the matrix is recessed due to preferential material removal during the polishing process (FIG. 3B). Such high flatness of protruding diamond, and controlled height of diamond protrusions, offer significant advantages in the conditioning of the CMP pads.

Those skilled in the art will appreciate that many variants of diamond-reinforced RBSC are plausible. Among the parameters that can be varied are diamond content, diamond particulate size and diamond particulate shape.

More specifically, the diamond content can be engineered to range from about 1 volume percent (vol %) to about 70 vol %. The diamond reinforcement can be in the form of particulate, with composites successfully fabricated using diamond particulate having nominal grain sizes, or average particle diameters, of 22, 35 and 100 microns, respectively. By way of comparison or calibration, 500 grit particulate (500 particles per inch) has an average diameter of about 13-17 microns, and a 325 mesh screen or sieve (325 openings per inch) passes particles having a size up to about 45 microns. The matrix component features SiC produced in-situ and typically some unreacted elemental silicon, as described previously. The amount of elemental Si present in the composite material is highly engineerable as is known by those skilled in the art; for example, can make up a majority of the material by volume (more than 50 vol %), or can be reduced to less than 1 vol %. To enable machining by EDM, however, the Si component may need to be interconnected for adequate electrical conductivity, suggesting quantities of at least about 5-10 vol %. Note, however, that the Applicant has produced a reaction bonded SiC composite containing about 60 vol % diamond particulate, about 30-40 vol % Si, and no more than about 10 vol % in-situ formed SiC.

Development of EDM-Capabale Version of Diamond-Containing RBSC

The basic principle behind electric discharge machining is the flow of significant amounts of electrical energy between an electrode of the EDM device and the workpiece (body to be machined). The electrical energy is in the form of a spark or arc. Here, the arc preferentially melts or evaporates the interconnected Si matrix component. This has the effect of leaving the diamond particulate reinforcement in relief, or "standing proud" of the surrounding Si/SiC matrix. There are at least two types of electrical discharge machining. The more familiar variety of EDM has the spark or arc emanating form a wire, thereby slicing through the target material. In the variety of EDM that is most relevant to the present work, the arc is between a shaped electrode and the workpiece.

Lapping

The Applicant has discovered that in one embodiment lapping the surface of a diamond-containing Si/SiC composite body also yields this diamond particle protrusion effect. Specifically, it preferentially removes some Si/SiC material, leaving the diamond reinforcement particles "standing proud" above the rest of the lapped surface; and (ii) it grinds or polishes off the peaks of the diamond particles, leaving "mesas" or plateaus, e.g., planarized particles. The lapping abrasive is diamond, with the following grit sizes used in order: 100, 45, 22, 12 and finally 6 micron-sized particulate. The latter is applied on a soft polyurethane cloth, while the other grits are applied using a ceramic plate.

Figure 3A:
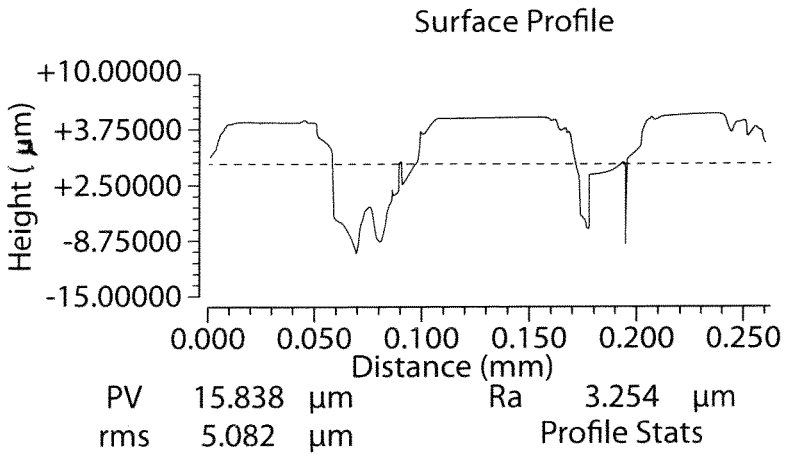
FIG. 3A is an exemplary profilometer trace of a lapped diamond-reinforced RBSC composite body.
Figure 3B:
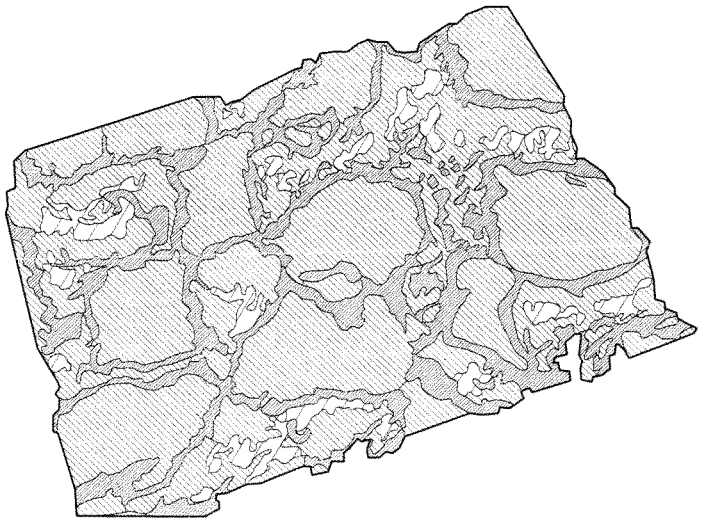
FIG. 3B is an RBSC-diamond showing recessed matrix and protruding diamond after polishing/lapping.

FIG. 3A shows a profilometer trace of the lapped diamond-reinforced RBSC body. FIG. 3B is a grayscale SEM image of the same lapped body. Both figures show that Si/SiC matrix material have been "scooped out" between diamond reinforcement grains, that the diamond grains have flat tops (have been "topped"), and that the edges of the diamond grains are blunted or rounded.

Exemplary processing steps for forming RBSC with diamond are as follows. Silicon carbide powder, diamond powder, water and a binder are mixed together to make a slurry. This slurry is then cast into a shaped mold and allowed to "pack down" or sediment under vibration to compact the ceramic particles to produce high packing. In the normal processing, the ceramic particle sizes are chosen so as to keep them well mixed and not segregate. At the end of the casting process, the excess aqueous binder is removed, the parts are demolded, dried, and carbonized to produce a self-supporting porous mass termed a "preform". The drying may be conducted in air in a temperature range between about 70 C and 200 C. The carbonizing pyrolyzes or chars the organic binder, decomposing it to carbon. The carbonizing is conducted in a non-oxidizing atmosphere typically at a temperature of about 600 C, but could occur in the range of 350 C up to about 1000 C. The non-oxidizing atmosphere may be vacuum or an inert atmosphere such as argon, helium or nitrogen.

Next, reactive infiltration is performed, whereby molten silicon wicks into the porous perform, chemically reacts with the non-diamond carbon (e.g., the pyrolyzed binder) but not with the diamond, at least not to any excessive degree, to form a dense composite body. Again, the atmosphere is non-oxidizing, which could be vacuum or inert gas such as argon or helium. Nitrogen gas may be reactive with the molten silicon at the processing temperatures for reactive infiltration, which perhaps is acceptable if some in-situ silicon nitride is desired in the formed composite body. The silicon does not have to be particularly pure. For example, 0.5 wt % iron as an impurity did not interfere with the infiltration. The vacuum does not have to be high or "hard", and in fact the reaction bonding process will proceed satisfactorily at atmospheric pressure in inert atmospheres such as argon or helium, particular if the temperature is somewhat higher than 1410° C. However, the processing temperature should not exceed about 2100° C. or 2200° C., as constituents may decompose or volatilize or change crystallographic form.

The resultant composite body contains diamond, SiC, and residual Si. The relative compositions can be tailored by choosing the proportions of the starting constituents in the casting slip. If the casting surface (typically the bottom surface is insufficiently flat, it can be further flattened using diamond grinding wheels.

These exemplary processing steps are used, and typically yield diamond-containing composite bodies where the diamond is fairly uniformly distributed throughout the composite body. However, the basic process can be modified to yield a non-uniform distribution of diamond particulate such as a functional gradient. For example, in the sedimentation casting process, Stokes Law may be used to produce a higher concentration of dense or large particulate bodies on the bottom of the casting relative to the concentration on the top of the casting, to be described in further detail below. In addition, a casting slurry containing, or not containing diamond particulate, can be cast around a layer of pre-positioned diamond particulate, grains or aggregate to yield a composite body, after infiltration, that features the pre-positioned diamond bodies predominantly at the surface of the composite body that corresponded to the bottom surface of the casting. In this embodiment, the size of the diamond bodies may be greater than 100 microns—for example, 200, 500 or even 1000 microns in diameter. Further, in this embodiment, the diamond bodies may be organized in terms of position at the base of the casting mold. For example, the diamond bodies could be positioned non-uniformly as clusters, or could be positioned randomly, or could be positioned uniformly and non-randomly such as in rows or arrays.

Figure 4A:
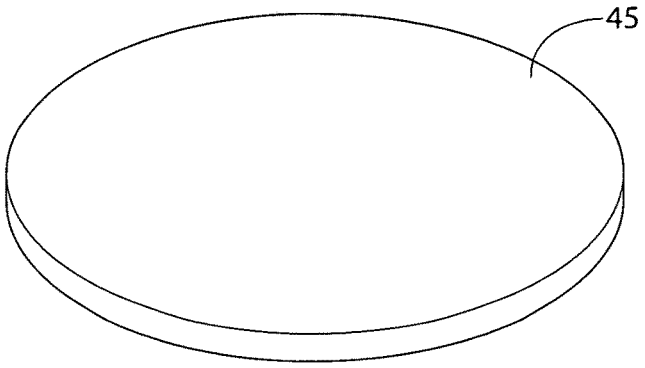
FIGS. 4A and 4B are perspective views of the contact surface and the rear surface of a disc-shaped CMP conditioner embodiment of the instant invention.
Figure 4B:
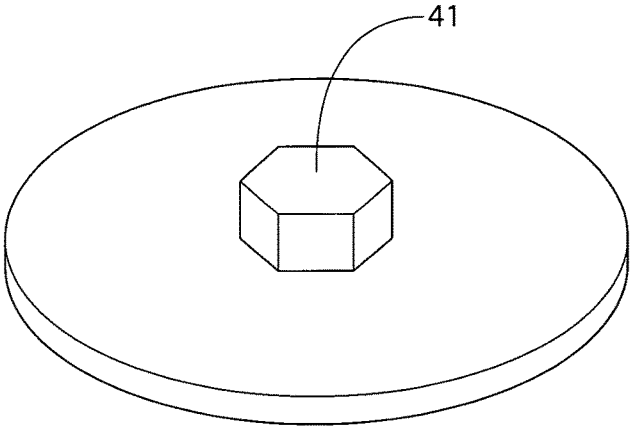
Figure 4C:
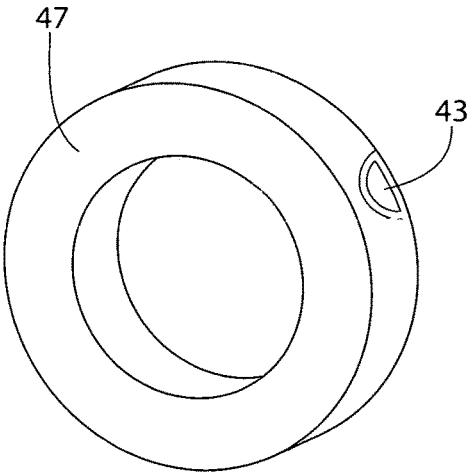
FIG. 4C is a perspective view of the contact surface of an annular or ring-shaped CMP conditioner embodiment of the instant invention.

Referring to FIGS. 4A-4C, the diamond-containing composite body may then be attached to a chassis, or perhaps attached directly to the arm of the machine used to recondition the CMP pad. The composite body or chassis may feature attachment or mounting structure 41, 43 for this purpose.

The instant CMP pad conditioners may have the general or approximate size as known pad conditioners, namely about 5 to 20 centimeters in effective diameter. In plan or top view, they may be circular, oval, or shaped as a polygon such as a hexagon or octagon. In any event, the surface 45, 47 configured to contact the CMP pad is engineered to be substantially flat. If the contact surface also features a treatment zone or region at a different elevation than the balance of the contact surface, then it is the treatment zone or region that provides most of the reconditioning work on the CMP pad. In any event, the surface that provides the bulk or majority of the reconditioning of the CMP pad is engineered to be flat to a high degree of precision, with the extremeties of the abrasive diamond particles (locations most distal from the lower elevation matrix) lying within 100 microns, and possibly within 50 microns and possibly within 20 microns, and possibly within 5 microns of planar. That is, the most distal points or surfaces on the protruding diamond particles have an elevation that is within 100, 50, 20 or perhaps 5 microns of one another.

EXAMPLES

Embodiments of the invention will now be further described with reference to the following Examples.

Example 1

EDM Method

Figure 5A:
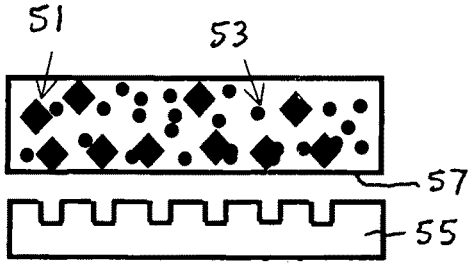
FIGS. 5A and 5B schematically illustrate an EDM method to produce a pad conditioner according to the current invention.
Figure 5B:
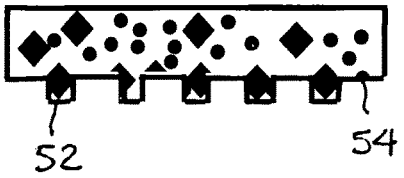

In this Example, made with reference to FIGS. 5A and 5B, a diamond-reinforced reaction-bonded silicon carbide composite is produced initially by conventional methods, but then is further processed by electrical discharge machining to yield the diamonds protruding form the surface.

Here, the low diamond content (10-20%) is chosen to produce the required spacing of the diamond 51 within the Si/SiC matrix. Next, the EDM electrode 55 is placed adjacent the surface to be machined 57. Carrying out EDM preferentially removes the Si/SiC matrix phases from one surface of the disk (the surface adjacent the EDM electrode), leaving behind protruding diamond 52 on the now-recessed surface 54.

Example 2

Casting Method Without Intentional Segregation

Figure 6A:
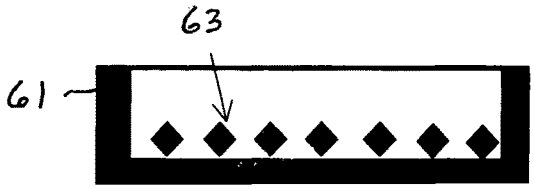
FIGS. 6A and 6B schematically illustrate a casting method to produce a pad conditioner according to the current invention.
Figure 6B:
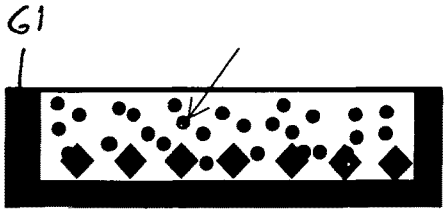

In this method, which is described with reference to FIGS. 6A and 6B, diamond particles or bodies are placed on the bottom of a casting mold, and a preform is cast on top of, and embedding, the diamond bodies.

First, a casting slip 65 is prepared. The slip contains the usual constituents for making a RBSC perform, but does not contain diamonds. Next, a casting mold 61 is prepared. Here, the mold is shaped to yield a disc-shaped perform. Large diamond particles 63 (e.g. 200 microns diameter) are then placed or positioned in a defined pattern (square, hexagonal etc.) at the bottom of the casting mold. Then, the non-diamond containing slip 65 is cast into the mold. The remaining process steps for making a RBSC body containing diamond on the surface (sedimentation, excess binder removal, demolding, drying, carbonizing and reaction bonding) are then carried out.

Finally, polishing is conducted on the diamond-containing surface of the RBSC disc-shaped body to preferentially remove the matrix phase, resulting in protruding diamond.

Example 3

Casting Method With Intentional Segregation

Figure 7A:
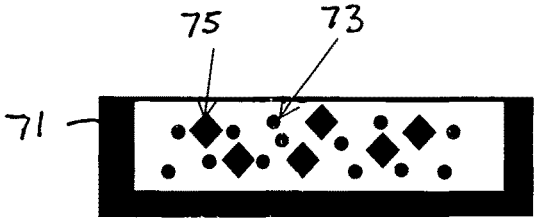
FIGS. 7A and 7B schematically illustrate a casting method with intentional segregation to produce a pad conditioner according to the current invention.
Figure 7B:
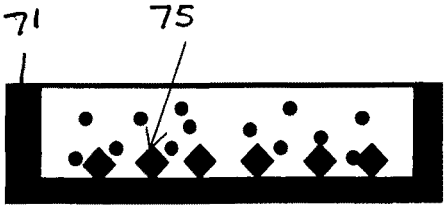

In this method, which is described with reference to FIGS. 7A and 7B, the diamond particles, which are larger in diameter and denser than SiC particles, are allowed to segregate during the sedimentation process to yield a functionally gradient perform: the concentration of diamond on the bottom of the casting will be greater than on the top of the casting.

First, a casting slip 73 is prepared containing small amount (5-10%) of coarse diamond 75 (e.g. 200 microns). This slip is intentionally made more dilute to promote faster settling of diamond particles compared to SiC particles. The slip is then cast into a mold 71 to prepare a disc-shaped perform. Next, vibration is applied to the casting mold to intentionally preferentially settle the diamond 75 to the bottom of the mold. Settling of the particles in the casting slip is governed by Stoke's Law:

$$V_s=[2(\rho_p-\rho_f)g\,R^2]/9\,\mu$$

Here, Vs is the settling velocity, ρ is the density, subscript p and f denote particle and the fluid, g is the gravitational constant, R is the particle radius, and μ is the fluid viscosity. Thus, the terminal settling velocity is directly proportional to the difference in densities of the particle and the liquid. Thus, heavier particles will settle faster. Since diamond (3.54 g/cc) has higher density than SiC (3.21 g/cc), it would settle faster. The settling velocity is also proportional to the square of the particle radius such that larger particles generally fall much faster than smaller particles. Therefore, diamond particle diameter (200 micron) is chosen to be significantly larger than that of the SiC (10-25 microns). Settling velocity is inversely proportional to the viscosity of the fluid (binder). Therefore, the slip is also intentionally made more dilute (lower viscosity) to promote faster settling.

The preform thus made should have most of the diamond segregated to the bottom side of the preform. This preform is then subjected to the remaining process steps described earlier to form a functionally gradient diamond-containing RBSC composite body. That is, one side of the composite body is rich in diamonds, and the opposite side is diamond-poor.

Finally, polishing is conducted on the diamond-rich surface to preferentially remove the matrix phase, resulting in protruded diamond.

Concept of "Treatment Zones" and Annular/Toroidal Shapes

Up to this point, it has almost been assumed that the contact surface is generally disc-shaped, and that this generally disc-shaped surface makes planar contact with the CMP pad polishing surface. While embodiments of the instant invention do not exclude this, they are not limited by it, either. Specifically, the contacting surface may have one or more zones or regions that are elevated with respect to other regions on the surface. Thus, these elevated regions would apply greater pressure to the CMP pad during reconditioning than other regions, even though the other regions may still be making nominal contact with the CMP pad. For example, the Applicant has in recent times discovered that a ring-shaped, or annular surface, is a very desirable shape for a lapping tool in an application different from that of the instant inventive application. A minimally constrained lapping tool (supported, for example, by means of a ball-and-socket joint) can be moved over an uneven surface. The lapping tool will conform to the uneven surface, but also inherently abrade asperities or other high spots, thereby restoring flatness. Referring to FIG. 4C illustrating an embodiment of the instant CMP pad conditioner, the inner and outside edges of the annular body can be rounded, or have a radius imparted to them, which helps to prevent the contact surface from digging in, tearing, or gouging the CMP pad. Thus, the annular conditioning body can take on a toroidal shape.

Moreover, the annular or toroidal treatment zone can be integrated with an otherwise disc-shaped body to provide a generally planar contact surface but with a slightly elevated and annular treatment zone near the periphery of the disc. In this embodiment, the contact surface with annular raised treatment zone may be fabricated by selective lapping, electric discharge machining, or by providing a mold for casting such desired contact surface of the perform precursor of the composite material.

INDUSTRIAL APPLICABILITY

Embodiments of the instant invention should find immediate utility in the semiconductor fabrication industry, e.g., for reconditioning chemical/mechanical planarization (CMP) pads. The composite material that is in contact with the CMP pad surface is very resistant to the chemical used in CMP. Also, the diamond particulate abrasive is embedded in a matrix to which it is well matched in terms of thermal expansion coefficient, thereby reducing internal strain, which may be at least partially responsible for diamond abrasive becoming detached from the substrate in prior art reconditioning tools. Further, the instant treatment surface is engineered such that the protruding diamond particles do not protrude more than about halfway out of the surrounding or embedding matrix.

The treatment zone or region is that zone or region of the contacting surface that is most responsible for reconditioning of the CMP pad. This treatment zone or region may be disc-shaped, or it may be annular (more ring-shaped). An annular shape has certain advantages in that it naturally tends to recondition the pad surface back to a flat condition; that is, this shape naturally tends to remove high spots on the CMP pad. The inner and outer edges of the annulus, or annular treatment zone, may have a radius applied or imparted to them; that is, the ring may be given a slight toroidal shape. The application of a radius to an edge can reduce the chance of gouging of the CMP pad during conditioning.

Although much of the forgoing discussion has focused on the specific issue of conditioning the polishing surface of a chemical/mechanical planarization (CMP) pad, one of ordinary skill in the art will recognize other applications requiring reconditioning of a formerly flat surface, particularly where such surface has accumulated debris, and where it is important that the abrasive used for such reconditioning not detach from its substrate. The skilled person will recognize other applications where the reconditioning tool should be corrosion-resistant.

The skilled person will appreciate that various modifications may be made to the invention herein described without departing from the scope or spirit of the invention as defined in the appended claims.

What is claimed is:

1. A chemical-mechanical planarization pad conditioner, comprising:

a body configured to condition a CMP pad, said body having a surface configured to contact the polishing surface of a CMP pad during conditioning of the pad polishing surface;

wherein said contacting surface of said body includes a composite material having diamond particles embedded in, and distributed throughout, a volume of a matrix including silicon carbide;

wherein said matrix at said contacting surface is recessed relative to diamond particles at said surface such that at least a portion of said diamond particles at said contacting surface protrude from said matrix, wherein the tops of the protruding diamond particles are planarized and a point on substantially all of said protruding diamond particles that is most distal from said matrix lies within about 50 microns of planar, and wherein another portion of said diamond particles, different than the diamond particles at said surface, are entirely beneath the contacting surface, and wherein the matrix includes no more than about 10 volume percent in-situ formed silicon carbide.

2. The chemical-mechanical planarization pad conditioner of claim 1, wherein said contacting surface further comprises a treatment zone.

3. The chemical-mechanical planarization pad conditioner of claim 2, wherein said treatment zone is planar.

4. The chemical-mechanical planarization pad conditioner of claim 2, wherein said treatment zone is annular.

5. The chemical-mechanical planarization pad conditioner of claim 2, wherein at least said protruding diamond particles within said treatment zone are planarized.

6. The chemical-mechanical planarization pad conditioner of claim 4, wherein said protruding diamond particles protrude from the surrounding matrix no more than about 50% of their size.

7. The chemical-mechanical planarization pad conditioner of claim 4, further comprising structure for attachment to a chemical-mechanical planarization pad conditioning machine.

8. The chemical-mechanical planarization pad conditioner of claim 1, wherein said diamond particles in said composite material have a volume percentage concentration gradient that varies inversely with distance from the contacting surface.

9. The chemical-mechanical planarization pad conditioner of claim 8, wherein the volume percentage concentration gradient varies according to Stokes Law.

10. The chemical-mechanical planarization pad conditioner of claim 8, wherein the volume percentage concentration gradient varies according to the settling of diamond particles within the matrix during formation of the matrix according to the following:

$$V_s = \frac{[2(\rho_P - \rho_f)gR^2]}{9\mu}$$

where $V_s$ is the settling velocity, p is the density, subscript p and f denote diamond particle and the matrix in a fluid form during formation, respectively, g is a gravitational constant, R a radius of the diamond particles, and μ is a fluid viscosity of the matrix in a fluid form during formation.

11. The chemical-mechanical planarization pad conditioner of claim 1, wherein said protruding diamond particles exhibit a size in a range of 20 microns to 1000 microns.

12. The chemical-mechanical planarization pad conditioner of claim 1, wherein at least a portion of said protruding diamond particles at said contacting surface protrudes from said matrix by a distance of at least 10 microns.

13. The chemical-mechanical planarization pad conditioner of claim 1, wherein said diamond particles in said composite material are located preferentially at or near said contacting surface.

14. The chemical-mechanical planarization pad conditioner of claim 13, wherein said diamond particles in said composite material is present throughout said Silicon Carbide-containing matrix.

15. The chemical-mechanical planarization pad conditioner of claim 1, wherein said diamond particles have a concentration gradient that varies inversely with distance from said contacting surface.

16. The chemical-mechanical planarization pad conditioner of claim 15, wherein said matrix includes reaction-bonded Silicon Carbide.

17. The chemical-mechanical planarization pad conditioner of claim 1, wherein said diamond particles in said composite material have a volume percentage concentration from about 1 volume percent to about 70 volume percent.

18. The chemical-mechanical planarization pad conditioner of claim 1, wherein the matrix includes elemental silicon from about 5 volume percent to about 40 volume percent.

19. The chemical-mechanical planarization pad conditioner of claim 1, wherein the diamond particles are uniformly distributed throughout the volume of the composite material.

20. The chemical-mechanical planarization pad conditioner of claim 1, wherein the diamond particles are distributed throughout substantially the entire volume of the composite material.

21. The chemical-mechanical planarization pad conditioner of claim 1, wherein the tops of the protruding diamond particles have a planarized width from about 40 microns to about 70 microns.

22. A chemical-mechanical planarization pad conditioner, comprising:

a body configured to condition a CMP pad, said body having a surface configured to contact the polishing surface of a CMP pad during conditioning of the pad polishing surface;

wherein said contacting surface of said body includes a composite material having diamond particles embedded in, and distributed throughout, a volume of a matrix including silicon carbide;

wherein said matrix at said contacting surface is recessed relative to diamond particles at said surface such that at least a portion of said diamond particles at said contacting surface protrude from said matrix, wherein the tops of the protruding diamond particles are planarized and a point on substantially all of said protruding diamond particles that is most distal from said matrix lies within about 50 microns of planar, and wherein another portion of said diamond particles, different than the diamond particles at said surface, are entirely beneath the contacting surface, and wherein the matrix includes interconnected silicon.

23. The chemical-mechanical planarization pad conditioner of claim 22, wherein the matrix comprises at least about 5-10 percent silicon by volume.

24. The chemical-mechanical planarization pad conditioner of claim 22, wherein said contacting surface further comprises a treatment zone.

25. The chemical-mechanical planarization pad conditioner of claim 24, wherein said treatment zone is planar.

26. The chemical-mechanical planarization pad conditioner of claim 24, wherein said treatment zone is annular.

27. The chemical-mechanical planarization pad conditioner of claim 24, wherein at least said protruding diamond particles within said treatment zone are planarized.

28. The chemical-mechanical planarization pad conditioner of claim 26, wherein said protruding diamond particles protrude from the surrounding matrix no more than about 50% of their size.

29. The chemical-mechanical planarization pad conditioner of claim 26, further comprising structure for attachment to a chemical-mechanical planarization pad conditioning machine.

30. The chemical-mechanical planarization pad conditioner of claim 22, wherein said diamond particles in said composite material have a volume percentage concentration gradient that varies inversely with distance from the contacting surface.

31. The chemical-mechanical planarization pad conditioner of claim 30, wherein the volume percentage concentration gradient varies according to Stokes Law.

32. The chemical-mechanical planarization pad conditioner of claim 30, wherein the volume percentage concentration gradient varies according to the settling of diamond particles within the matrix during formation of the matrix according to the following:

$$V_s = \frac{[2(\rho_P - \rho_f)gR^2]}{9\mu}$$

where $V_s$ is the settling velocity, ρ is the density, subscript p and f denote diamond particle and the matrix in a fluid form during formation, respectively, g is a gravitational constant, R a radius of the diamond particles, and μ is a fluid viscosity of the matrix in a fluid form during formation.

33. The chemical-mechanical planarization pad conditioner of claim 22, wherein said protruding diamond particles exhibit a size in a range of 20 microns to 1000 microns.

34. The chemical-mechanical planarization pad conditioner of claim 22, wherein at least a portion of said protruding diamond particles at said contacting surface protrudes from said matrix by a distance of at least 10 microns.

35. The chemical-mechanical planarization pad conditioner of claim 22, wherein said diamond particles in said composite material are located preferentially at or near said contacting surface.

36. The chemical-mechanical planarization pad conditioner of claim 35, wherein said diamond particles in said composite material is present throughout said Silicon Carbide-containing matrix.

37. The chemical-mechanical planarization pad conditioner of claim 22, wherein said diamond particles have a concentration gradient that varies inversely with distance from said contacting surface.

38. The chemical-mechanical planarization pad conditioner of claim 37, wherein said matrix includes reaction-bonded Silicon Carbide.

39. The chemical-mechanical planarization pad conditioner of claim 22, wherein said diamond particles in said composite material have a volume percentage concentration from about 1 volume percent to about 70 volume percent.

40. The chemical-mechanical planarization pad conditioner of claim 22, wherein the matrix includes elemental silicon from about 5 volume percent to about 40 volume percent.

41. The chemical-mechanical planarization pad conditioner of claim 22, wherein the diamond particles are uniformly distributed throughout the volume of the composite material.

42. The chemical-mechanical planarization pad conditioner of claim 22, wherein the diamond particles are distributed throughout substantially the entire volume of the composite material.

43. The chemical-mechanical planarization pad conditioner of claim 22, wherein the tops of the protruding diamond particles have a planarized width from about 40 microns to about 70 microns.

* * * * *